US006494344B1

(12) United States Patent
Kressel, Sr.

(10) Patent No.: US 6,494,344 B1
(45) Date of Patent: Dec. 17, 2002

(54) LIQUID DISPENSING CONTAINER

(76) Inventor: Joseph A. Kressel, Sr., 512 Junior Ave., Schofield, WI (US) 54476

( * ) Notice: Subject to any disclaimer, the term of this patent is extended or adjusted under 35 U.S.C. 154(b) by 0 days.

(21) Appl. No.: 09/967,759

(22) Filed: Sep. 28, 2001

(51) Int. Cl.[7] ..... B67D 5/38

(52) U.S. Cl. ..... 222/157; 222/175; 222/481.5; 222/529; 222/530

(58) Field of Search ..... 222/157, 175, 222/185.1, 465.1, 481.5, 529, 530, 538

(56) References Cited

U.S. PATENT DOCUMENTS

| | | | | | |
|---|---|---|---|---|---|
| 3,250,434 | A | * | 5/1966 | Howlett | 222/465.1 |
| 4,688,643 | A | * | 8/1987 | Carter et al. | 222/175 |
| 4,834,269 | A | * | 5/1989 | Cone | 222/465.1 |
| 4,869,402 | A | * | 9/1989 | Ash, Jr. | 222/175 |
| 4,972,972 | A | | 11/1990 | Goguen | 222/461 |
| 5,056,691 | A | | 10/1991 | Tolbert | 215/31 |
| 5,108,016 | A | * | 4/1992 | Waring | 222/530 |
| 5,472,124 | A | | 12/1995 | Martushev | 222/465.1 |
| 5,597,097 | A | | 1/1997 | Morris | 222/529 |
| 5,667,113 | A | | 9/1997 | Clarke et al. | 215/31 |
| 5,860,566 | A | * | 1/1999 | Lucs | 222/157 |

* cited by examiner

*Primary Examiner*—Joseph A. Kaufman

(57) ABSTRACT

A liquid dispensing container for conveniently storing and dispensing various types of fluids. The liquid dispensing container includes a container capable of storing a volume of fluid, a strap attached to an upper surface of the container, a fill cap removably attached to a threaded nipple, a transparent or semi-transparent viewing portion within at least one side of the container, a dispensing hose fluidly connected to a lower portion of the container, a dispensing nozzle attached to the end of the dispensing hose, and a clasp attached to the container for catchably receiving the dispensing hose. A plurality of marker lines and relevant indicia are preferably positioned adjacent the viewing portion which has an elongate vertical structure thereto for allowing an individual to determine the amount of fluid within or dispensed from the container. The dispensing hose and the nozzle are preferably comprised of a relatively smaller structure for allowing the individual to fit the nozzle into compact areas.

8 Claims, 4 Drawing Sheets

LIQUID DISPENSING CONTAINER

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to fluid containers and more specifically it relates to a liquid dispensing container for conveniently storing and dispensing various types of fluids.

2. Description of the Prior Art

Liquid storage containers have been in use for years. Typically, a conventional liquid storage container is comprised of a reservoir structure having various shapes, a filling aperture, and a dispensing aperture. Sometimes a rigid spout will be attachable to the dispensing aperture to aid in dispensing fluid from the container.

The main problem with conventional fluid containers is that they are difficult to utilize in dispensing fluid into a relatively small reservoir such as but not limited to a gas tank on a lawnmower. A further problem with conventional fluid containers is that they do not provide an accurate means for measuring the level of fluid contained within thereof. Another problem with conventional fluid containers is that they do not have a convenient system for physically transporting.

Examples of patented devices which are related to the present invention include U.S. Pat. No. 5,597,097 to Morris; U.S. Pat. No. 5,472,124 to Martushev; U.S. Pat. No. 4,972,972 to Goguen; U.S. Pat. No. 5,667,113 to Clarke et al; U.S. Pat. No. 5,056,691 to Tolbert; U.S. Pat. No. 4,901,878 to Humphries; U.S. Pat. No. 4,781,314 to Schoonover et al; U.S. Pat. No. D370,379 to Klein et al; U.S. Pat. No. 5,469,993 to Hauf et al; U.S. Pat. No. 5,226,574 to Durinzi, Jr; U.S. Pat. No. 4,856,664 to Gillispie et al; U.S. Pat. No. 4,811,870 to Bianco; U.S. Pat. No. 6,068,163 to Kihm.

While these devices may be suitable for the particular purpose to which they address, they are not as suitable for conveniently storing and dispensing various types of fluids. Conventional fluid storage containers are not designed for efficient utilization particularly in the dispensing of fluids from within.

In these respects, the liquid dispensing container according to the present invention substantially departs from the conventional concepts and designs of the prior art, and in so doing provides an apparatus primarily developed for the purpose of conveniently storing and dispensing various types of fluids.

SUMMARY OF THE INVENTION

In view of the foregoing disadvantages inherent in the known types of fluid containers now present in the prior art, the present invention provides a new liquid dispensing container construction wherein the same can be utilized for conveniently storing and dispensing various types of fluids.

The general purpose of the present invention, which will be described subsequently in greater detail, is to provide a new liquid dispensing container that has many of the advantages of the fluid containers mentioned heretofore and many novel features that result in a new liquid dispensing container which is not anticipated, rendered obvious, suggested, or even implied by any of the prior art fluid containers, either alone or in any combination thereof.

To attain this, the present invention generally comprises a container capable of storing a volume of fluid, a strap attached to an upper surface of the container, a fill cap removably attached to a threaded nipple, a transparent or semi-transparent viewing portion within at least one side of the container, a dispensing hose fluidly connected to a lower portion of the container, a dispensing nozzle attached to the end of the dispensing hose, and a clasp attached to the container for catchably receiving the dispensing hose. A plurality of marker lines and relevant indicia are preferably positioned adjacent the viewing portion which has an elongate vertical structure thereto for allowing an individual to determine the amount of fluid within or dispensed from the container. The dispensing hose and the nozzle are preferably comprised of a relatively smaller structure for allowing the individual to fit the nozzle into compact areas.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a liquid dispensing container that will overcome the shortcomings of the prior art devices.

A second object is to provide a liquid dispensing container for conveniently storing and dispensing various types of fluids.

Another object is to provide a liquid dispensing container that allows the user to easily carry and transport a fluid.

An additional object is to provide a liquid dispensing container that is able to receive and dispense various types of fluids.

A further object is to provide a liquid dispensing container that utilizes a convenient measuring system for allowing for accurate calculation of fluid dispensed from or input into the container.

Another object is to provide a liquid dispensing container that utilizes an easily to grasp and manipulate nozzle structure for filling smaller containers.

A further object is to provide a liquid dispensing container that reduces the amount of spillage during the filling of a reservoir.

Another object is to provide a liquid dispensing container that dispenses fluids in a cleaner, environmentally friendly, safer and accurate manner.

A further object is to provide a liquid dispensing container that allows an individual to accurate mix two types of fluids together in a desired ratio.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
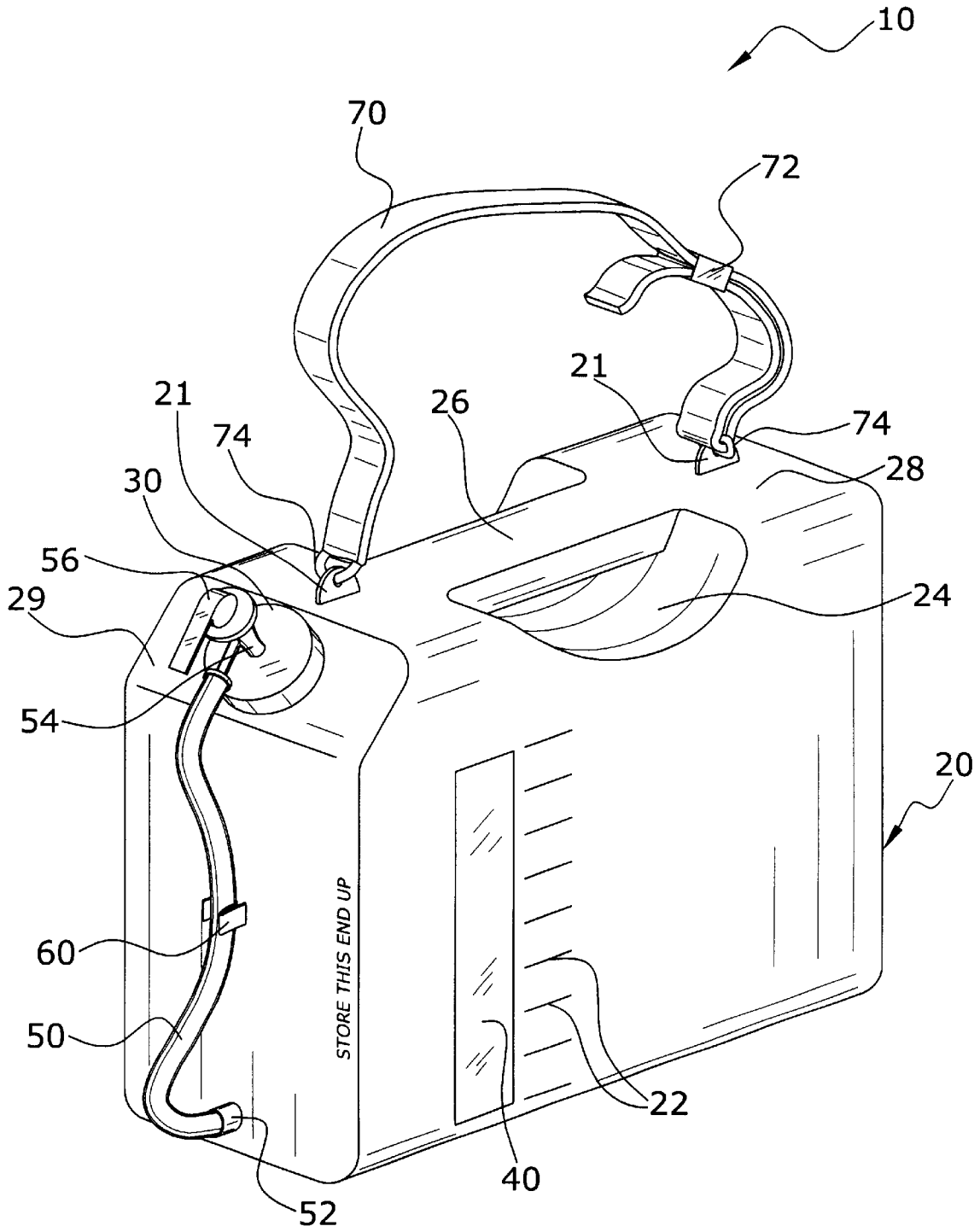
FIG. 1 is an upper perspective view of the present invention.

Turning now descriptively to the drawings, in which similar reference characters denote similar elements throughout the several views, FIGS. 1 through 4 illustrate a liquid dispensing container 10, which comprises a container 20 capable of storing a volume of fluid, a strap 70 attached to an upper surface 28 of the container 20, a fill cap 30 removably attached to a threaded nipple 23, a transparent or semi-transparent viewing portion 40 within at least one side of the container 20, a dispensing hose 50 fluidly connected to a lower portion of the container 20, a dispensing nozzle 52 attached to the end of the dispensing hose 50, and a clasp 60 attached to the container 20 for catchably receiving the dispensing hose 50. A plurality of marker lines 22 and relevant indicia are preferably positioned adjacent the viewing portion 40 which has an elongate vertical structure thereto for allowing an individual to determine the amount of fluid within or dispensed from the container 20. The dispensing hose 50 and the nozzle 52 are preferably comprised of a relatively smaller structure for allowing the individual to fit the nozzle 52 into compact areas.

As shown in FIGS. 1 through 4 of the drawings, the container 20 preferably has a rectangular structure for receiving a volume of fluid. However, the container 20 may have various shapes not illustrated within the drawings. The container 20 is preferably formed for receiving various volumes of fluids. In addition, the container 20 is preferably formed for receiving various types of fluids such as but not limited to gasoline, antifreeze, washer fluid, brake fluid, transmission fluid, power steering fluid, motor oil, liquid bleach, liquid laundry detergent and other types of fluids.

Figure 2:
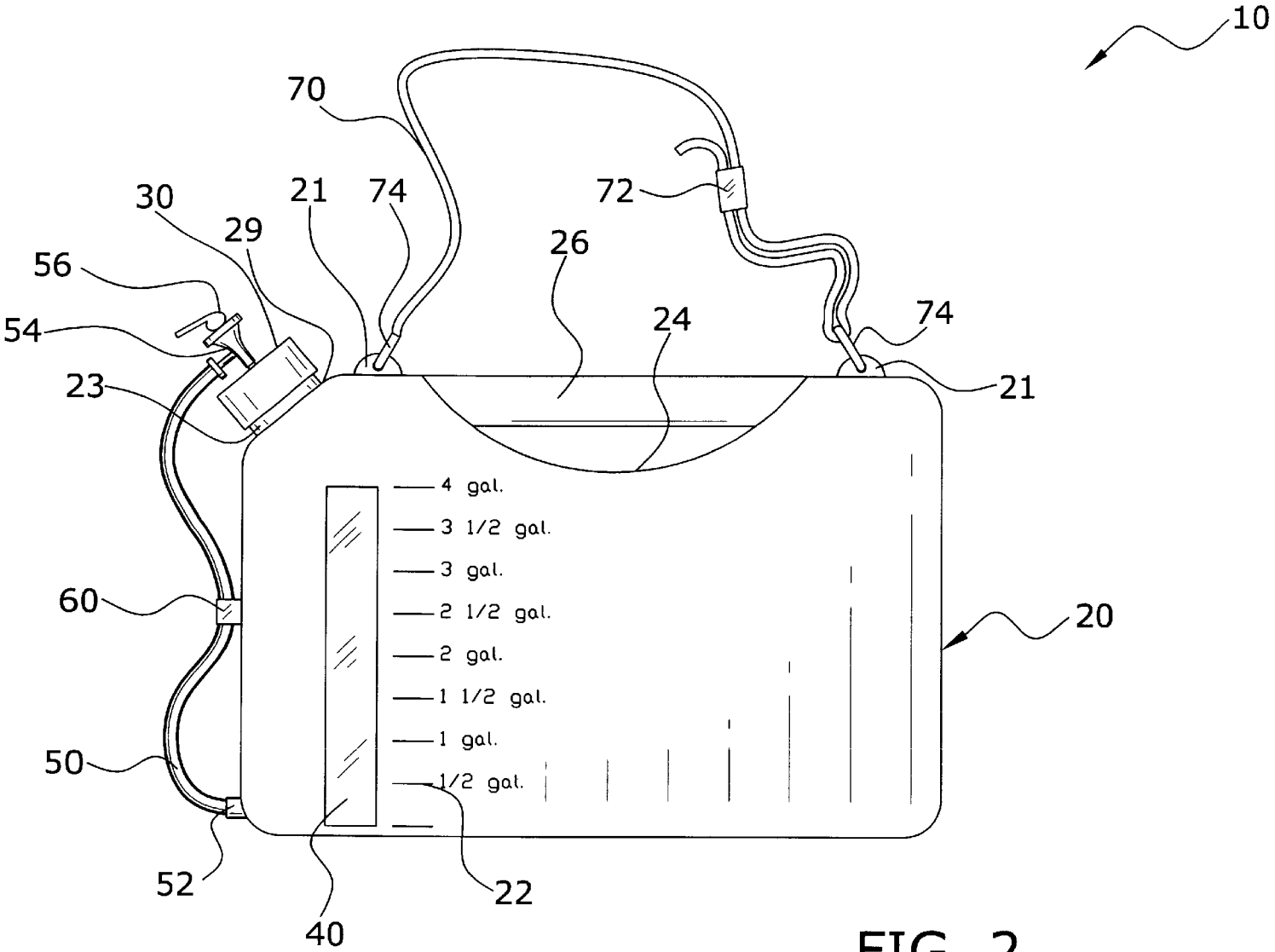
FIG. 2 is a side view of the present invention with the hose connected to the clamp.

The container 20 preferably has an upper surface 28, a plurality of sidewalls and a floor defining a fluid reservoir. The container 20 preferably has a handle 26 integral within the upper portion of the container 20 and with a depression 24 extending beneath the handle 26 as best illustrated in FIGS. 1 and 2 of the drawings. The depression 24 is preferably curved in shape, however various other shapes for the depression 24 may be utilized.

Figure 3:
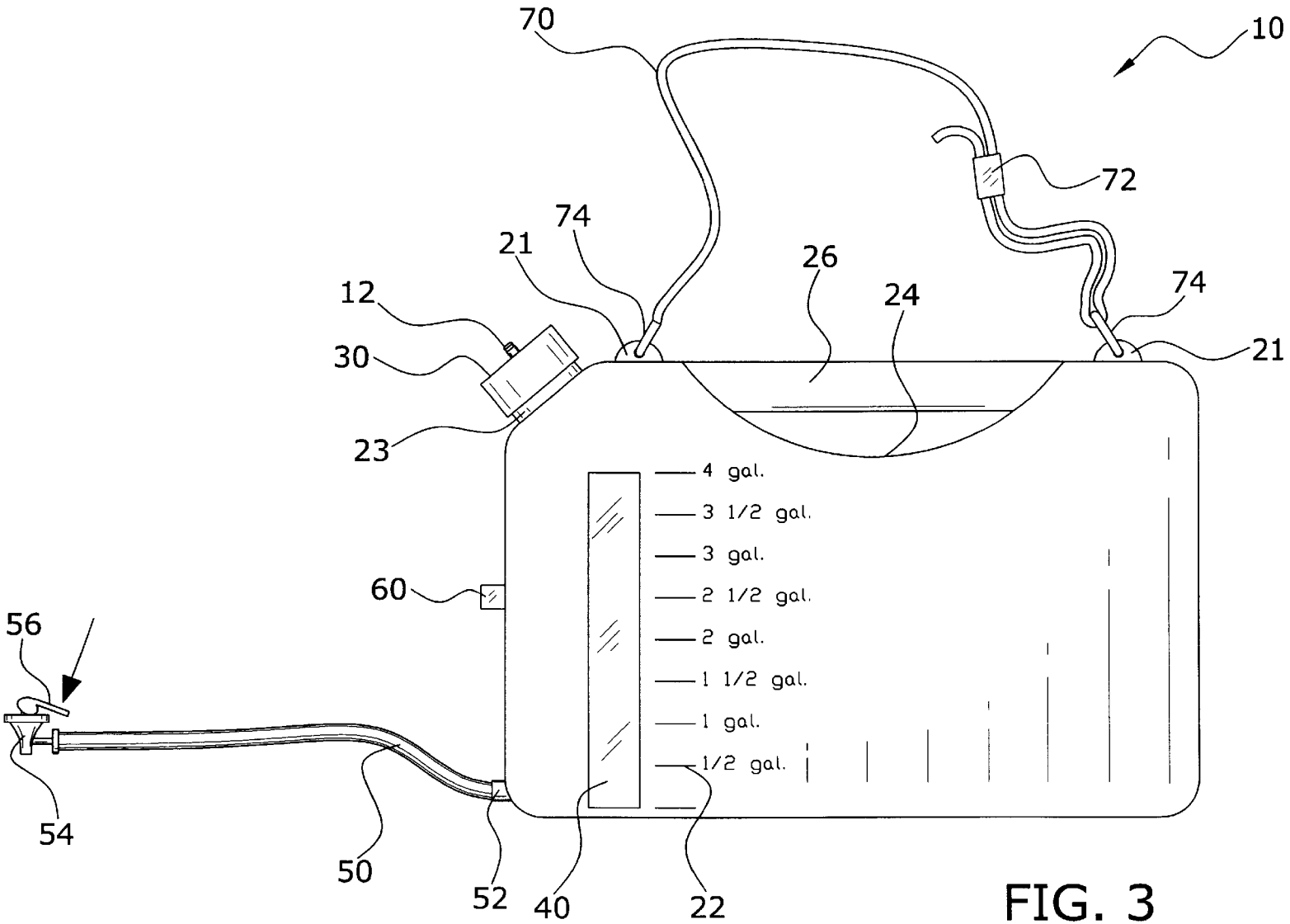
FIG. 3 is a side view of the present invention with the hose removed from the clamp for dispensing a fluid within.
Figure 4:
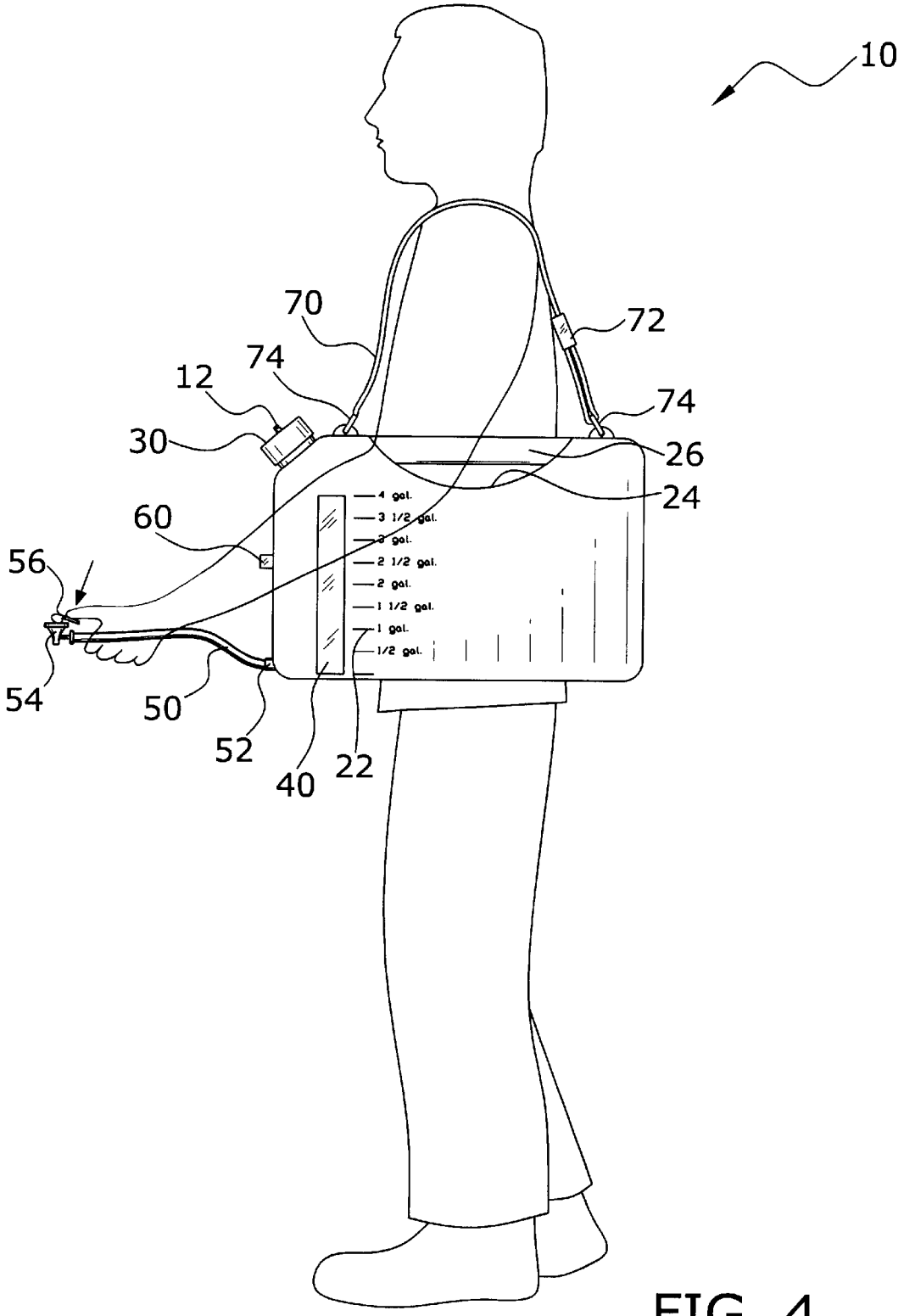
FIG. 4 is a side view of an individual carrying the present invention upon their shoulder.

As shown in FIGS. 1 and 2 of the drawings, the container 20 preferably has an angled portion 29 within the upper front portion of the container 20. A threaded nipple 23 or similar structure preferably is positioned within the angled portion 29 that is engagable by a fill cap 30 for allowing selective filling of the container 20 with a fluid. The threaded nipple 23 preferably has an aperture within sufficient to receive significant quantities of fluid from conventional dispensing means. The fill cap 30 preferably includes a vent nipple 12 within which allows for the ventilation of the container 20 during dispensing of fluid as is best shown in FIG. 3 of the drawings. The nozzle 54 is preferably formed for snugly engaging the vent nipple 12 during nonuse as shown in FIGS. 1 and 2 of the drawings. When the user desires to utilize the nozzle 54, the user simply removes the nozzle 54 from the vent nipple 12 and then dispenses the liquid contained within the container 20.

As shown in FIGS. 1 through 3 of the drawings, at least two brackets 21 are attached to the upper surface 28 of the container 20 for receiving a corresponding number of loops 74. A length of strap 70 is secured to the loops 74 at opposing ends hereof and may be adjusted by an adjusting member 72. The strap 70 is preferably sufficient in length to be carried about the shoulder of an individual as shown in Figure of the drawings.

As best illustrated in FIGS. 2 and 3 of the drawings, a viewing portion 40 is positioned within at least one side of the container 20 in a vertical manner for allowing for the measurement of fluid input into or dispensed from the container 20. The viewing portion 40 is preferably comprised of a transparent or semi-transparent material. The viewing portion 40 may be molded within the container 20 or secured with a conventional securing means within the container 20. The viewing portion 40 is preferably comprised of an elongated rectangular structure as best illustrated in FIGS. 2 and 3 of the drawings. The viewing portion 40 preferably extends from the bottom portion of the container 20 to the upper portion of the container 20. There are preferably two viewing portions 40 utilized on opposing sides of the container 20, however it can be appreciated that any number of viewing portions 40 may be utilized. The user is able to view the interior fluid level through the viewing portion 40.

As shown in FIGS. 2 and 3 of the drawings, a plurality of marker lines 22 are positioned upon the outer surface of the container 20 adjacent to the viewing portion 40. The marker lines 22 represent specific units of measurement such as gallons, liters, quarts and the like. Adjacent to the marker lines 22 are a corresponding indicia of measurement to indicate the fluid volume within the container 20 based upon the upper level of the fluid as shown by the viewing portion 40 with respect to the marker lines 22. The user is then able to input into or dispense from the container 20 a desired volume of fluid. This allows the user to add a specific volume of a second fluid to an existing volume of a first fluid within the container 20 to be mixed such as oil being mixed with gasoline.

As shown FIGS. 1 through 4 of the drawings, at least one clasp 60 is attached to the front portion of the container 20 for catchably receiving a portion of the hose when not in use. The clasp 60 is preferably comprised of a U-shaped structure that snugly receives the outer surface of the hose as best illustrated in FIG. 1 of the drawings.

As shown in FIGS. 1 through 4 of the drawings, a rigid coupler 52 is fluidly connected to the front lower portion of the container 20. A length of dispensing hose is fluidly connected to the rigid coupler 52 wherein the dispensing hose 50 is comprised of a flexible material such as but not limited to rubber, plastic or the like. The length of the hose may be one foot or more in length. The diameter of the dispensing hose 50 may be comprised of various sizes of diameters, however the preferred diameter is less than ¾ of an inch.

As shown in FIGS. 1 through 4 of the drawings, a dispensing nozzle 52 is fluidly connected to the distal end of the dispensing hose 50 opposite of the rigid coupler 52. The dispensing nozzle 52 is preferably relatively smaller in size for fitting within compact areas. The nozzle 52 preferably has a lever 56 or other actuating means to allow for the selective dispensing of fluid from the container 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A liquid dispensing container, comprising:

a container capable of receiving a volume of fluid;

a nipple fluidly connected within an upper portion of said container for inputting fluid within said container;

a dispensing hose comprised of an elongate and flexible structure fluidly connected to a lower portion of said container;

a nozzle fluidly connected to a distal end of said dispensing hose, wherein said nozzle is capable of allowing selective termination of fluid flow through said dispensing hose;

a handle integral within said upper portion of said container;

a depression extending within said upper portion of said container beneath said handle, wherein said depression is comprised of an arcuate structure;

at least one viewing portion position within said container comprised of an elongate vertical structure and comprised of a transparent or semi-transparent material for allowing viewing of a fluid level within said container;

a plurality of marker lines comprised of a horizontal structure within an outer surface of said container adjacent to said elongate vertical structure;

a plurality of corresponding indicia measurements adjacent each of said plurality of marker lines representing a volume within said container;

a clasp secured to a front portion of said container for catchably receiving said dispensing hose during non-use;

a pair of brackets attached to an upper surface of said container; and a strap attached between said pair of brackets for allowing transporting of said container upon a shoulder of an individual.

2. The liquid dispensing container of claim 1, wherein said strap includes a pair of loops that are attached to said pair of brackets.

3. The liquid dispensing container of claim 1, wherein said strap includes an adjusting member for allowing adjustment of a length of said strap.

4. The liquid dispensing container of claim 1, including a fill cap removably engagable with said nipple.

5. The liquid dispensing container of claim 1, wherein said nipple is positioned within an angled portion within an upper front portion of said container.

6. The liquid dispensing container of claim 1, including a vent nipple positioned within said nipple.

7. The liquid dispensing container of claim 6, wherein said nozzle is formed for snugly and removably attaching about said vent nipple.

8. A liquid dispensing container, comprising:

a container capable of receiving a volume of fluid;

a nipple fluidly connected within an upper portion of said container for inputting fluid within said container;

a dispensing hose comprised of an elongate and flexible structure fluidly connected to a lower portion of said container;

a nozzle fluidly connected to a distal end of said dispensing hose, wherein said nozzle is capable of allowing selective termination of fluid flow through said dispensing hose;

a handle integral within said upper portion of said container;

a depression extending within said upper portion of said container beneath said handle, wherein said depression is comprised of an arcuate structure;

at least one viewing portion position within said container comprised of an elongate vertical structure and comprised of a transparent or semi-transparent material for allowing viewing of a fluid level within said container;

a plurality of marker lines comprised of a horizontal structure within an outer surface of said container adjacent to said elongate vertical structure;

a plurality of corresponding indicia measurements adjacent each of said plurality of marker lines representing a volume within said container;

a clasp secured to a front portion of said container for catchably receiving said dispensing hose during non-use;

a pair of brackets attached to an upper surface of said container;

a strap attached between said pair of brackets for allowing transporting of said container upon a shoulder of an individual;

wherein said strap includes a pair of loops that are attached to said pair of brackets;

wherein said strap includes an adjusting member for allowing adjustment of a length of said strap;

a fill cap removably engagable with said nipple;

wherein said nipple is positioned within an angled portion within an upper front portion of said container;

a vent nipple positioned within said nipple; and wherein said nozzle is formed for snugly and removably attaching about said vent nipple.

* * * * *